US005877731A

United States Patent [19]

Bobowicz et al.

[11] Patent Number: 5,877,731

[45] **Date of Patent: *Mar. 2, 1999**

[54] PHASED ARRAY ANTENNA HAVING AN INTEGRATED GROUND PLANE AND METHOD FOR PROVIDING THE SAME

[76] Inventors: Daniel Bobowicz, 6070 Rock Glen Dr.; William B. Yablon, 6317 Hampton Pl., both of Elkridge, Md. 21227

[ * ] Notice: This patent issued on a continued prosecution application filed under 37 CFR 1.53(d), and is subject to the twenty year patent term provisions of 35 U.S.C. 154(a)(2).

[21] Appl. No.: 680,304

[22] Filed: Jul. 11, 1996

[51] Int. Cl.[6] ..... H01Q 1/48

[52] U.S. Cl. ..... 343/848; 343/824; 343/846

[58] Field of Search ..... 343/725, 797, 343/829, 830, 841, 846, 848, 838, 767, 817, 700 MS

[56] References Cited

U.S. PATENT DOCUMENTS

| | | | |
|---|---|---|---|
| 2,691,102 | 10/1954 | Masters | 343/817 |
| 2,757,369 | 7/1956 | Darling | 343/817 |
| 3,665,478 | 5/1972 | Dempsey | 343/846 |
| 4,912,482 | 3/1990 | Woloszczuk | 343/841 |
| 5,111,214 | 5/1992 | Kumpfbeck et al. | 343/841 |
| 5,337,066 | 8/1994 | Hirata et al. | 343/841 |
| 5,355,142 | 10/1994 | Marshall et al. | 343/830 |
| 5,628,053 | 5/1997 | Araki et al. | 343/700 |
| 5,661,499 | 8/1997 | Epshtein et al. | 343/911 R |

*Primary Examiner*—Hoanganh Le
*Assistant Examiner*—Tho Phan
*Attorney, Agent, or Firm*—Walter G. Sutlciff

[57] ABSTRACT

A phased antenna array includes conductive stubs integrated with at least one of the radiators of the array. The conductive stubs form a ground plane for the array. Preferably, each horizontally polarized radiator of the array has a plurality of conductive stubs integrated therewith. Voids between adjacent radiators and conductive ground stubs may be filled with a conductive material to provide electrical contact therebetween. Conductive stubs on opposing faces of adjacent radiators are preferably interlocking. Advantageously, the conductive stubs are triangular.

13 Claims, 1 Drawing Sheet

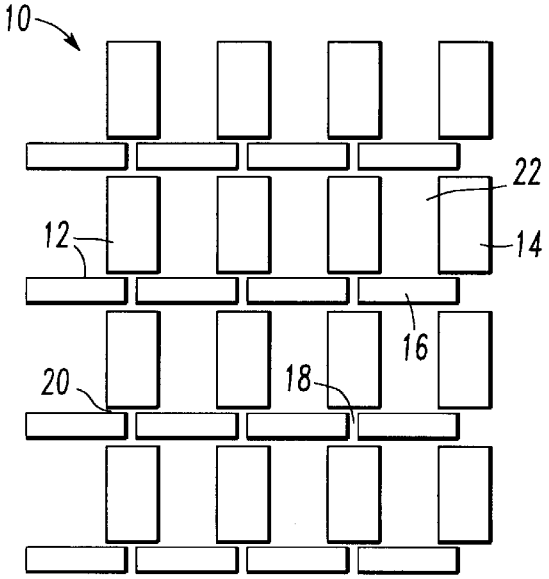
FIG. 1
FIG. 2
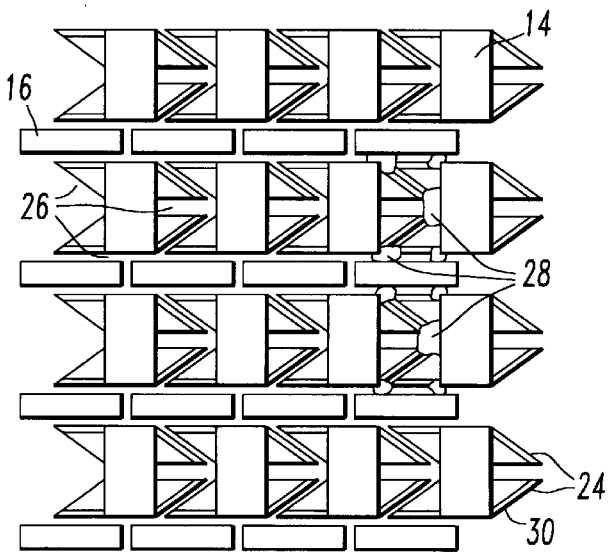
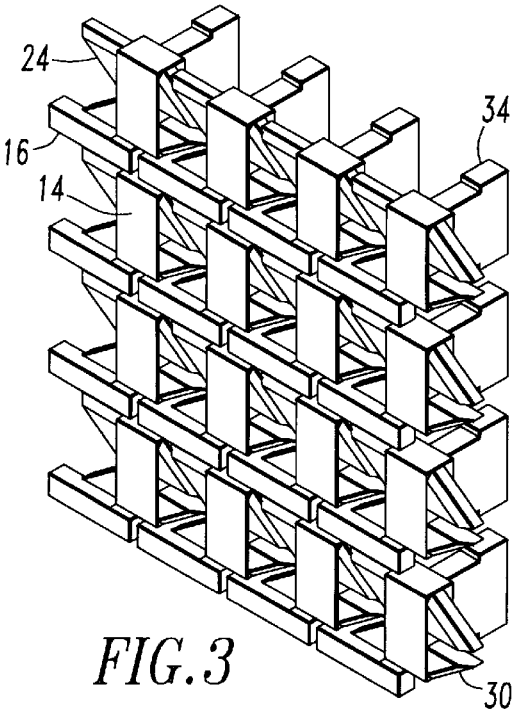
FIG. 3
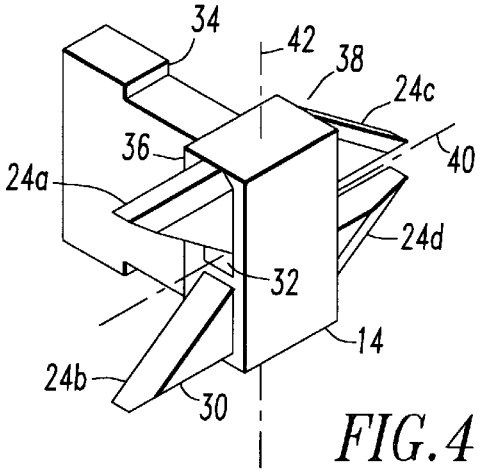
FIG. 4

PHASED ARRAY ANTENNA HAVING AN INTEGRATED GROUND PLANE AND METHOD FOR PROVIDING THE SAME

BACKGROUND OF THE INVENTION

1. Field of the Invention

The present invention is directed to a phased array antenna, and, more particularly, to a phased array antenna having a ground plane integrated therewith.

2. Description of the Related Art

Densely populated radiators in a phased array antenna present assembly problems in how the radiators are terminated into a ground plane. A typical solution is to use a metal face plate as the ground plane. This metal face plate is machined to provide cut-outs for the radiators and is secured to the antenna array using conventional mechanical attachment, e.g., screws. If the array has separately polarized radiators that operate at higher frequencies, i.e., on the order of mm wavelengths, the spacing between the radiators is on the order of thousandths of an inch. This close spacing makes the fabrication of the face plate impractical.

SUMMARY OF THE INVENTION

Therefore, it is an object of the present invention to provide a practical ground plane for a phased array antenna operating at higher frequencies. It is a further object of the present invention to provide a ground plane for a phased array antenna which reduces assembly complexity and array weight.

These and other objects of the present invention are provided by a plurality of radiators arranged in a pattern, and conductive stubs integrated with at least some of the plurality of radiators, the conductive stubs forming a ground plane for the antenna array. The antenna array may further include contact means for providing electrical contact between adjacent ones of the plurality of radiators and the conductive stubs. The contact means preferably includes a conductive material filling, e.g., conductive epoxy, connecting some or all voids between adjacent ones of the plurality of radiators and the conductive stubs.

Advantageously, the conductive stubs are integrated with some or each of horizontally polarized radiators of the plurality of radiators. The conductive stubs are preferably triangular. Each radiator having conductive stubs integrated therewith has two triangular stubs on opposite surfaces. The triangular stubs on a same surface are preferably mirror images of one another and the conductive stubs on opposing faces of adjacent radiators interlock with one another. The conductive stubs may include a chamfer feature.

These and other objects of the present invention may also be rendered by a method of providing a ground plane in an antenna array comprising the steps of integrating conductive stubs with some radiators of the antenna array, arranging the radiators of the antenna array in a pattern, and supplying electrical contact between adjacent surfaces in the pattern, thereby providing a ground plane for the antenna array. The supplying step may further include filling connective voids with a conductive material. The integrating step may further include integrating conductive stubs with each horizontally polarized radiator of the antenna array and/or arranging the conductive stubs such that conductive stubs on opposing faces of adjacent radiators interlock.

These and other objects of the present invention will become more readily apparent from detailed description given hereinafter. However, it should be understood that the detailed description and specific examples, while indicating the preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limited to the present invention and wherein:

FIG. 1 is a front view of an array radiator grid;

FIG. 2 is a front view of the array radiator grid of FIG. 1 with the ground plane of the present invention integrated therewith;

FIG. 3 is a perspective side view of the integrated ground plane of FIG. 2; and FIG. 4 is a perspective side view of an individual horizontally polarized radiator integrated with the ground plane of the present invention.

DETAILED DESCRIPTION OF THE PREFERRED EMBODIMENTS

An array radiator grid 10 is shown in FIG. 1. The array 10 is composed of separate polarized radiators 12 arranged in a rectangular grid. The radiators 12 are separate pieces that are assembled together at a feeding manifold (not shown). The radiators 12 consist of horizontally polarized radiators 14 and vertically polarized radiators 16.

As can be seen in FIG. 1, an intra-row gap 18 between adjacent vertically polarized radiators 16 and an inter-row gap 20 between adjacent horizontally polarized radiators 14 are both relatively small such that there is little ground plane surface therebetween. However, a spacing 22 between adjacent horizontally polarized radiators 14 is relatively large. Typically, the spacing 22 is approximately an order of magnitude larger than either the intra-row gap 18 and the inter-row gap 20. For example, the intra-row gap 18 may be approximately 6 mil, the inter-row gap 20 may be approximately 9 mil, and the spacing 22 may be approximately 100 mil.

The radiators 12 are impedance matched under the assumption that there is a continuous ground plane surrounding them. The intra-row gap 18 and the inter-row gap 20 are small enough that they only need to be filled at critical nodes such that there is a connection provided, especially regarding the inter-row gap 20. Otherwise, leaving these gaps unfilled does not seriously affect this assumption. However, the spacing 22 must be substantially filled in order for the array 10 to perform properly, i.e., the spacing 22 must be reduced such that the continuous ground plane assumption is not seriously affected.

A preferred embodiment of filling the spacing 22 is shown in FIGS. 2–4. In FIG. 2, the ground plane is incorporated into the radiators 12. Ground plane stubs 24 create most of the ground plane surface after the radiators 12 are assembled together. A ground plane formed by the ground plane stubs 24 is made electrically continuous by filling ground plane voids 26 therein with a conductive filler 28. The ground plane voids 26 represented by the intra-row gap 18 and the inter-row gap 20 must clearly also be filled at least to the extent required to provide continuous contact. The ground plane voids 26 only need to be filled with the conductive filler 28 at discrete locations at sample fill points as shown in FIG. 2 as long as the spacing of the fill points is less than about a quarter of a wavelength. Clearly when fully filled, there will be contact between all adjacent surfaces.

Alternatively, the entire plane of the array 10 may be filled with the conductive filler 28 and then skimmed to fill in the voids 26. The conductive filler 28 may be, for example, a conductive epoxy or metallized bond film.

The ground plane stubs 24 preferably include chamfers 30 molded therein. The chamfers 30 facilitate the filling of the voids 26 and allows the ground plane in a certain surface, i.e., flush with the surface of the radiators 12, to be flat.

Preferably, the ground plane stubs 24 are in the form of triangular projections as shown in FIGS. 2–4. The triangular shape facilitates assembly, minimizes the impact of the impedance discontinuity in the radiator waveguide and provides interlocking benefits. The triangular ground plane stubs 24 are impedance matched with a stub iris 32, shown in FIG. 4, which projects into the dielectric waveguide. The triangular ground plane stubs 24 even more preferably are right triangles, with the shortest side thereof mounted on a surface of the radiator 12. A ridge 34 also provides impedance matching in the waveguide.

Also preferably, the ground plane stubs 24 are provided, for each radiator 12 having ground plane stubs 24 integrated therewith, on opposite surfaces, e.g., 36, 38, of the radiator 12. Further, each surface 36, 38 of the radiator 12 preferably includes two ground plane stubs 24*a*, 24*b* or 24*c*, 24*d*, respectively. The upper ground plane stubs 24*a*, 24*c* are mirror images of lower ground planes stubs 24*b*, 24*d* about a central horizontal axis 40. The upper ground plane stubs 24*a* of the first surface 36 is a mirror image of the upper ground plane stub 24*c* about a central vertical axis 42 therebetween. Similarly, the lower ground plane stub 24*b* of the first surface 36 is a mirror image of the lower ground plane stub 24*d* about the central vertical axis 42. When the radiators 12 are arranged such that the first surface 36 of a radiator faces the second surface 38 of an adjacent radiator, as shown in FIGS. 2 and 3, a desirable interlocking pattern is formed.

The ground plane stubs 24 are preferably offset below the surface of the front plane of the radiators 12. This allows the radiator's aperture to be metallized during construction and the metallization to then be selectively removed from the radiators without affecting metallization on the ground plane stubs 24. If the radiators are injection molded, the ground plane stubs 24 are preferably injection molded along with the horizontally polarized radiators 16 with which they are integral.

There are several mechanical benefits of using ground plane stubs 24 integrated with the horizontally polarized radiators 14 as compared to a continuous fabricated ground plane. The weight of the design is reduced, assembly problems of inserting many radiators through a common surface is alleviated, and no additional hardware is required to attach the radiators to the ground plane.

The invention being thus described, it will be apparent that the same may be varied in many ways. For example, other shapes, such as rectangles, may be used for the ground plane stubs. Such variations are not to be regarded as a departure from the spirit and scope of the invention, and such modifications as would be obvious to one skilled in the art are intended to be included within the scope of the following claims.

What is claimed is:

1. An antenna array comprising:

a plurality of radiators arranged in a pattern of horizontally and vertically polarized radiators each having a front radiating surface, a pair of adjoining side surfaces, and a rear surface;

said front radiating surfaces of said horizontally polarized radiators being substantially flat and coplanar; and, mirror imaged pairs of spaced apart triangular conductive stubs projecting from said side surfaces of selected ones of said horizontally polarized radiators and additionally including electrical contact means at predetermined points of said conductive stubs and adjacent vertically polarized radiators to form a ground plane for the antenna array, said conductive stubs being molded with said selected ones of said horizontally polarized radiators so as to be offset relative to the front radiating surfaces thereof, and wherein the mirrored image pairs of triangular conductive stubs of adjacent horizontally polarized radiators are mutually reversed in orientation to provide an interlocking configuration of triangular conductive stubs between immediately adjacent horizontally polarized radiators.

2. The antenna array as recited in claim 1, wherein said electrical contact means comprises conductive material filling selected connecting voids between adjacent ones of said plurality of radiators and said conductive stubs.

3. The antenna array as recited in claim 1, wherein said electrical contact means comprises conductive material filling all voids between adjacent ones of said plurality of radiators and said conductive stubs.

4. The antenna array as recited in claim 3, wherein said conductive stubs include chamfers to facilitate the filling of the voids.

5. The antenna array as recited in claim 1, wherein said conductive stubs are molded with each of said horizontally polarized radiators.

6. An antenna array as recited in claim 1 wherein said pattern of radiators comprise a matrix of rows of vertically polarized radiators and columns of horizontally polarized radiators.

7. An antenna array as recited in claim 1 wherein said pair of adjoining side surfaces of said horizontally polarized radiators are substantially flat and mutually parallel and wherein said conductive stubs comprise elements configured as right triangles.

8. An antenna array as recited in claim 7 and additionally including an impedance matching stub iris between the conductive stubs of the mirror imaged pairs of conductive stubs.

9. An antenna array as recited in claim 1 wherein said rear surfaces of said horizontally polarized radiators are substantially flat and additionally including an impedance matching ridge projecting from said rear surfaces.

10. An antenna array as recited in claim 1 wherein said electrical contact means comprises a conductive filler at discrete locations having a spacing less than about one-quarter wavelength.

11. A method of fabricating a ground plane in a phased array antenna including a plurality of horizontally and vertically polarized radiators each having a front radiating surface, a pair of adjoining side surfaces, and a rear surface, wherein said front radiating surfaces of said horizontally polarized radiators are substantially flat and coplanar, comprising the steps of:

molding mirror imaged pairs of spaced triangular conductive stubs on the side surfaces of a predetermined number of horizontally polarized radiators of said antenna, wherein the mirrored image pairs of triangular conductive stubs of adjacent horizontally polarized radiators are mutually reversed in orientation to provide an interlocking configuration of triangular conductive stubs between immediately adjacent horizontally polarized radiators;

arranging said radiators in a pattern of plural columns of horizontally polarized radiators and plural rows of vertically polarized radiators; and selectively forming electrical contact between adjacent surfaces of said stubs and immediately adjacent vertically polarized radiators, thereby providing a ground plane for the antenna array.

12. The method as recited in claim 11, wherein said forming step comprises filling connective voids between said stubs and adjacent vertically polarized radiators with a conductive material.

13. The method as recited in claim 11, wherein said molding step comprises molding conductive stubs with each horizontally polarized radiator of said antenna array.

* * * * *